United States Patent [19]

Loge et al.

[11] Patent Number: 4,480,745

[45] Date of Patent: Nov. 6, 1984

[54] INTERLOCKING MODULAR DISPLAY RACK SYSTEM, COMPONENT UNITS THEREFOR, AND METHODS

[75] Inventors: David B. Loge, Cary, N.C.; William A. Cole, Wyncote, Pa.; Kevin J. Migdal, Raleigh, N.C.

[73] Assignee: GoodMark Foods, Inc., Raleigh, N.C.

[21] Appl. No.: 484,684

[22] Filed: Apr. 13, 1983

[51] Int. Cl.[3] ..... B65D 21/02

[52] U.S. Cl. ..... 206/44 R; 206/45.14; 206/443; 206/514; 211/71; 211/126; 211/133; 220/23.4; 312/107

[58] Field of Search ..... 206/44 R, 45, 45.11, 206/45.14, 45.15, 503, 504, 505, 507, 509, 511, 512, 513; 211/71, 113, 118, 126, 128, 133, 188, 194; 220/23.4, 23.6, 23.83, 23.86; 248/489, 496; 312/107, 111

[56] References Cited

U.S. PATENT DOCUMENTS

| | | | |
|---|---|---|---|
| D. 256,199 | 8/1980 | Burke et al. . | |
| 986,395 | 3/1911 | King | 220/23.4 |
| 1,688,003 | 10/1928 | Darby . | |
| 1,740,424 | 12/1929 | Blaine . | |
| 1,866,117 | 7/1932 | Logan . | |
| 1,929,615 | 10/1933 | Tanner | 206/45.11 |
| 1,951,972 | 3/1934 | Fraser . | |
| 2,242,296 | 5/1941 | Fraser . | |
| 2,286,831 | 6/1942 | Ressinger | 211/71 |
| 2,410,700 | 11/1946 | Zalkind | 206/504 |
| 2,624,582 | 1/1953 | Molinar . | |
| 3,523,694 | 8/1970 | Oliver | 206/509 |
| 3,651,976 | 3/1972 | Chadbourne . | |
| 3,760,937 | 9/1973 | Van Wyngarden et al. | 206/504 |
| 3,791,528 | 2/1974 | Brendgord . | |
| 3,857,482 | 12/1974 | Shelton | 220/23.4 |
| 3,926,314 | 12/1975 | Dogliotti | 211/71 |
| 3,955,681 | 5/1976 | DeZinno | 211/126 |
| 3,990,752 | 11/1976 | Hoffman et al. | 206/44 R |
| 4,069,941 | 1/1978 | Popplewell, Jr. et al. . | |
| 4,122,954 | 10/1978 | Slater . | |
| 4,277,758 | 10/1980 | Clare . | |

FOREIGN PATENT DOCUMENTS

| | | | |
|---|---|---|---|
| 0790060 | 11/1935 | France | 206/504 |
| 1334425 | 11/1963 | France | 211/71 |
| 0402604 | 12/1933 | United Kingdom | 312/107 |
| 1252887 | 11/1971 | United Kingdom | 211/126 |

*Primary Examiner*—George E. Lowrance
*Assistant Examiner*—Jimmy G. Foster
*Attorney, Agent, or Firm*—Bell, Seltzer, Park & Gibson

[57] ABSTRACT

A modular display rack system for displaying consumer articles includes a plurality of interlocked component units. Each component unit has a planar base and upstanding members at the perimeter of the base for receiving and holding containers of consumer articles. The upstanding members include means for interlocking adjacent component units of the system side to side.

16 Claims, 11 Drawing Figures

INTERLOCKING MODULAR DISPLAY RACK SYSTEM, COMPONENT UNITS THEREFOR, AND METHODS

BACKGROUND OF THE INVENTION

1. Field of the Invention

The invention relates to point-of-sale displays. More particularly, the invention relates to an interlocking modular point-of-sale display system for use in merchandising consumer articles.

2. Description of the Prior Art

The merchandising of consumer articles sold in individual units at snack bars, convenience stores, or the like, depends heavily upon appropriate point-of-sale displays. In the merchandising of certain comestible articles, e.g., beef jerky strips and spice sausages, it is critical to achieve ready consumer access to the articles.

Many comestible articles sold in individual units at convenience stores and snack bars are packaged in paperboard containers or "caddies" that contain up to 24 articles or more. The caddies, in turn, typically are held by a display rack that is located on the sales counter. When the complete contents of a caddy has been sold, the empty caddy is discarded and replaced with a full caddy.

A point-of-sale display rack for supporting the mentioned caddies in the merchandising of comestible articles is illustrated in U.S. Pat. No. Des. 256,199. It will be noted that the rack of U.S. Pat. No. Des. 256,199 is not adaptable in size or shape to conform to different merchandising geometries, and cannot be adjusted to accomodate the many different combinations of comestible articles that merchants may wish to display.

SUMMARY OF THE INVENTION

The modular display rack system of the present invention provides practical and versatile means for merchandising consumer articles that are packaged in caddies according to article type and are sold individually at sales counters. Component units of the system are interlocked side to side to define a desired array for holding the caddies for display.

The component units may be sized to hold different sizes of caddies. Thus, not only can the geometry of the display be tailored to the sales situation, but also the make up of the display in terms of caddy sizes and articles displayed can be precisely arranged as needed for the situation.

In one aspect of the present invention there is provided a modular display rack system formed from a plurality of interlocked component units. The individual component units of the system comprise a base having an upper support surface and an underside suitable for resting on a sales counter. A plurality of upstanding members extend from the sides of the base for supporting and containing the consumer article caddy so that it rests on the upper support surface of the base and is held against lateral shifting. The component units of the system are interlocked side to side by cooperative, mating interlock means that are defined by the upstanding members. A caddy containing a selected multiple number of consumer articles of particular type may be held by each of the component units of the system to provide an orderly display of several types of related consumer articles.

In another aspect, the invention may be defined in terms of the component units that make up the modular system. In particular embodiments, the component units are integrally formed from a single sheet of metal with the upstanding members joined to the base at 90 degree bend lines.

In yet another aspect, the invention may be viewed as a modular system including component units arranged in a desired array, a plurality of caddies held by the units and consumer articles of various types held by the caddies.

In still another aspect, the invention may be defined as a method of packaging and providing point-of-sale display for several different types of related consumer articles.

BRIEF DESCRIPTION OF THE DRAWINGS

The invention will be more fully understood from the following detailed description thereof taken in connection with the accompanying drawings, in which.

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
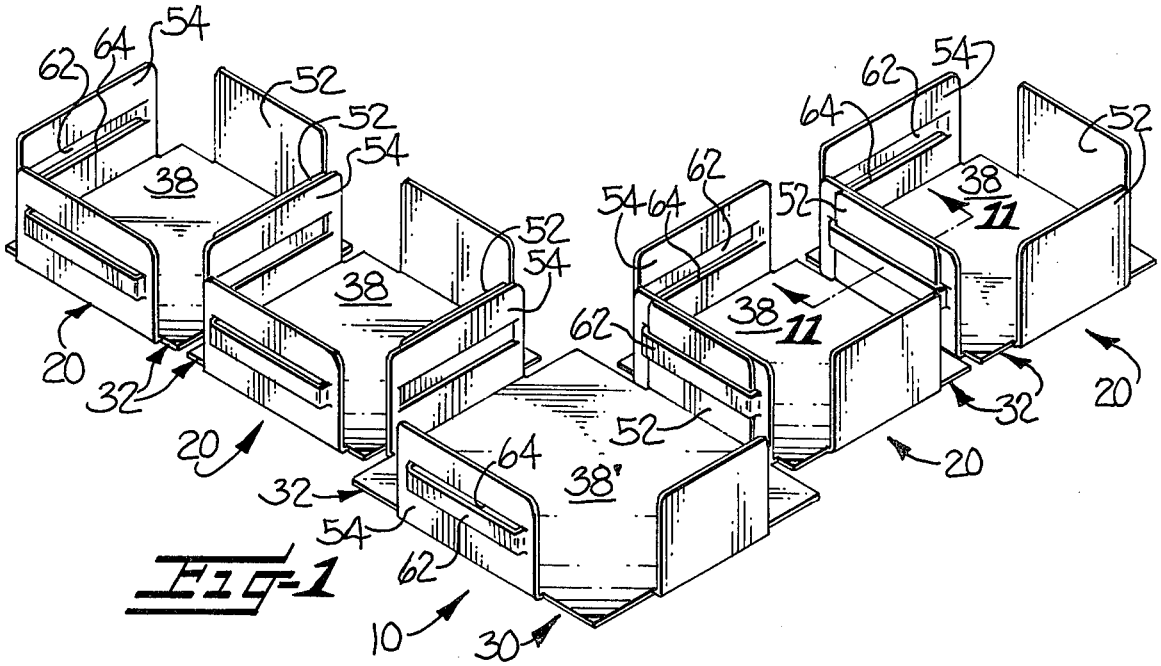
FIG. 1 is a perspective view of an interlocking modular display rack system constructed in accordance with the present invention.

Referring to the drawings, and particularly to FIG. 1, there is shown a modular display rack system 10 of the present invention. System 10 is formed from five component units: four identical units designated by the reference character 20 and a fifth unit 30. The five component units are interlocked side to side in a desired geometric configuration or array to form the modular system.

Figure 2:
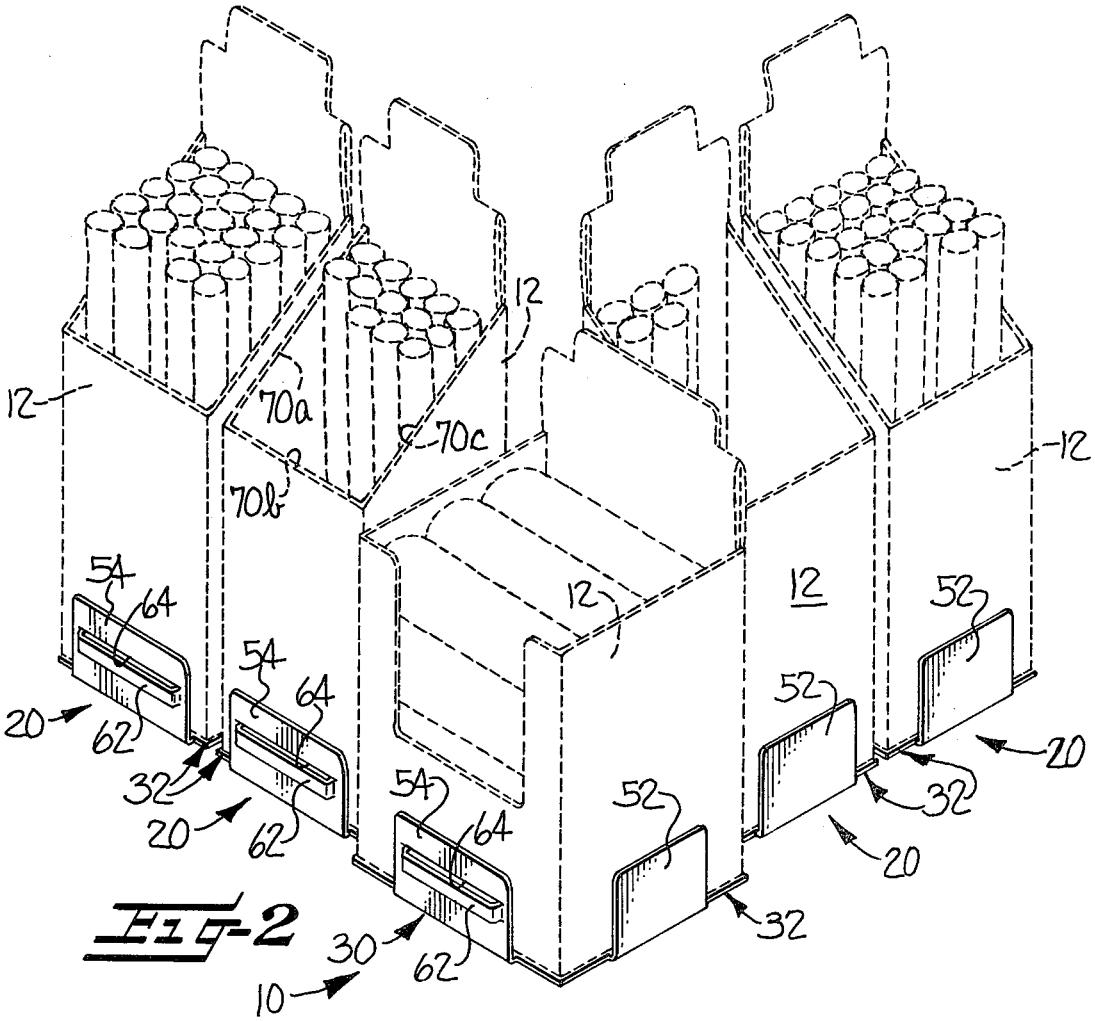
FIG. 2 is a perspective view of the system of FIG. 1 showing in dashed lines a plurality of caddies oriented for point-of-sale display.

As best shown in FIG. 2, the modular system 10 is used to hold multiple caddies, generally designated by the reference numeral 12. Each caddy contains consumer articles for point-of-sale display. The consumer articles shown in FIG. 2 comprise several types of comestible articles, such as beef jerky strips and spice sausages, that are packaged in caddies according to article type, preferably, such that each caddy holds only one type of article. While not shown in the drawings, the caddies preferably contain identifying indicia on their outer faces corresponding to the contents thereof.

With further reference to FIG. 2, it can be seen that the caddies for holding the consumer articles may take the form of paperboard containers that are rectangular, preferably square, in cross section. The caddies are used to ship a number of consumer articles, e.g. 24, or more, from the packaging plant to the retail location. At the retail location a top portion of the container is removed along perforated lines (for example, see the lines identified by reference numerals 70*a*, 70*b*, 70*c*, FIG. 2) to display the individual consumer articles contained therein for sale. In accordance with the present invention, the individual containers are held in position within the component units of the invention and, when each caddy is emptied, the caddy is discarded and replaced by a new caddy full of articles.

Figure 5:
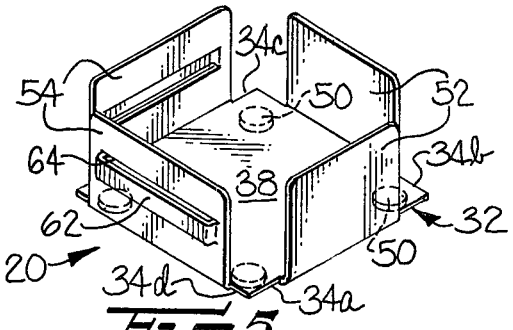
FIG. 5 is a perspective view of the smaller component unit of the system illustrated in FIGS. 1 and 2.
Figure 6:
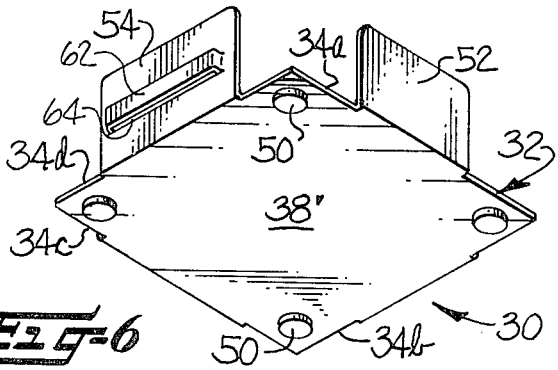
FIG. 6 is a bottom perspective view of the larger component unit of the system illustrated in FIGS. 1 and 2.
Figure 7:
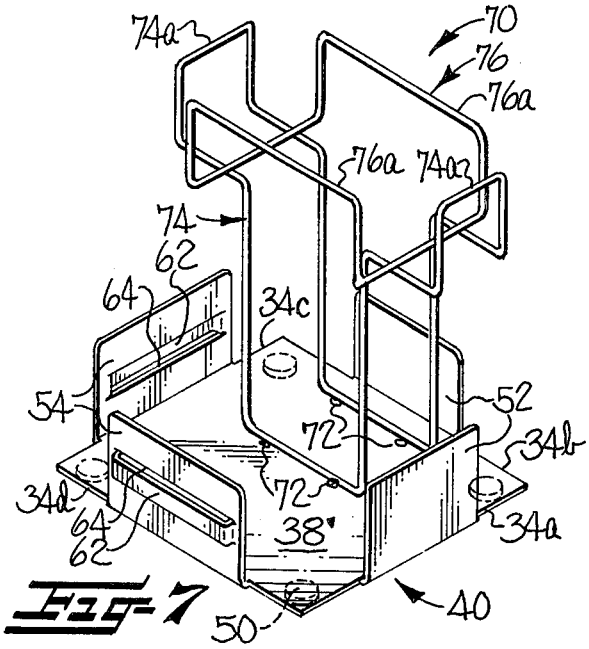
FIG. 7 is a perspective view of the tower unit of the system illustrated in FIGS. 3 and 4.
Figure 8:
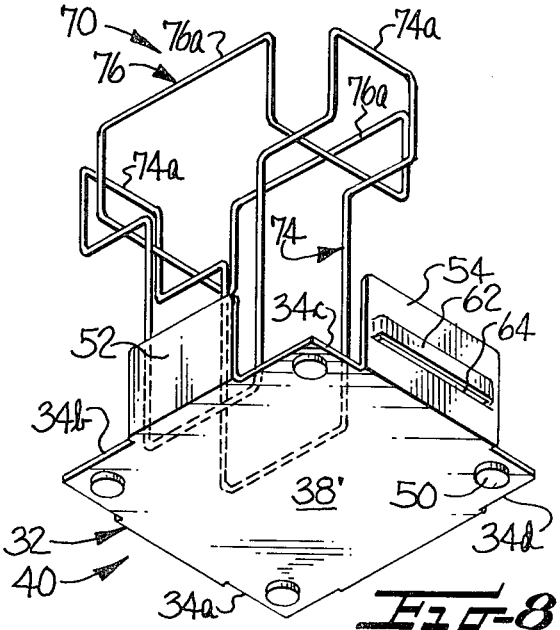
FIG. 8 is a bottom perspective view of the tower unit.

FIG. 5 illustrates one of the smaller base units 20. Unit 20 includes a square planar base 32 that defines four perimetric sides 34*a*, 34*b*, 34*c*, 34*d*. Base 32 has a shape and size approximating the cross sectional shape and size of the consumer article caddies (FIG. 2) that are adapted to be held thereby.

Base 32 further includes an upper support surface 38 for supporting the bottom of the caddy and an underside suitable for resting on a sales counter or like surface. In the illustrated embodiment, the underside includes four projecting feet 50 for engagement with the sales counter. In a particular manner of practicing the invention, the feet are formed from bonded rubber adhered to the underside of base 32.

Unit 20 further includes an upstanding member extending from each of the four perimetric sides of the base. The interior surfaces of the four upstanding members define support and containment means for engaging the exterior of a consumer article caddy and holding the caddy such that the bottom of the caddy is supported by support surface 38 and the caddy is held against lateral shifting.

In the illustrated embodiments, the upstanding members are integrally formed with base 32 and extend perpendicular from the base. In a preferred method of manufacture, the base and upstanding members are formed at a progressive die station from a single sheet of metal, such as 20 gauge steel, with the upstanding members being joined to the base at 90 degree bend lines.

The upstanding members are used in the interlocking of adjacent units in a horizontal side to side coplanar arrangement. To this end, the upstanding members include male members 52 and female members 54, shown as being arranged in opposing pairs, with each opposing pair being a male and female member.

Figure 10:
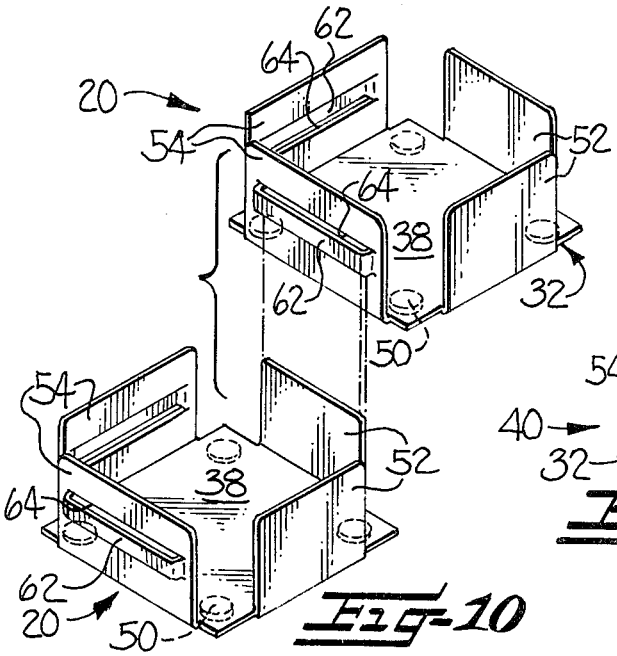
FIG. 10 is an exploded perspective view of two of the component units of FIG. 1, prior to assembly.

As best shown in FIG. 10, the male members take the form of an upright tongue-like blade. The female members 54 are somewhat wider than the male members 52 and include raised or outwardly offset portions 62 each of which defines an opening 64 for slideably receiving a male member of an adjacenht unit for interlocking engagement of adjacent units side to side. Each opening 64 is formed outwardly from the plane of its respective upstanding member and thereby defines a vertically oriented opening perpendicularly arranged with respect to the base 32 for receiving a male member. Raised or offset portions 62 may be formed as by a punching operation.

Figure 3:
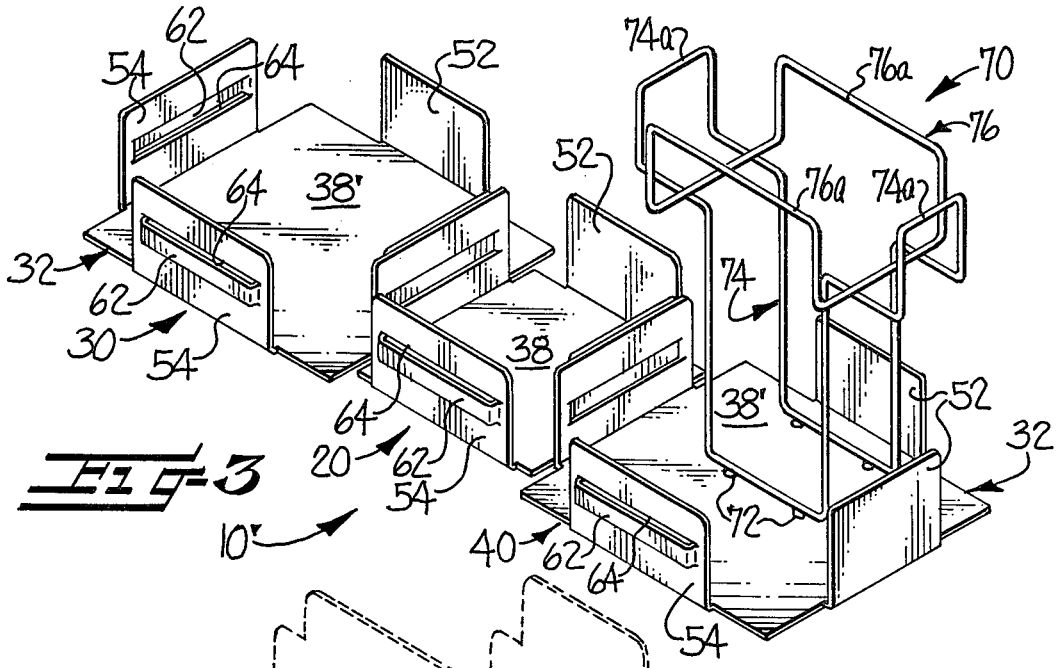
FIG. 3 is a perspective view of a modular display rack system having a straight-line geometry, and showing a third type of component unit having an upstanding tower.
Figure 11:
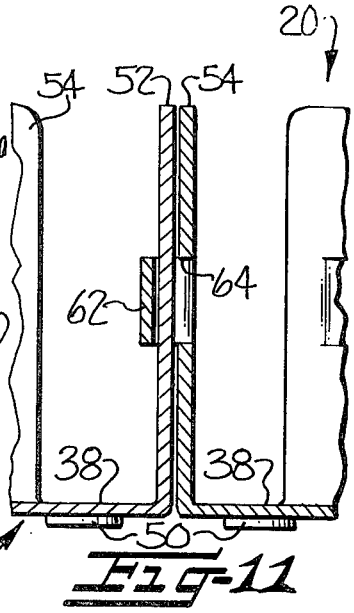
FIG. 11 is a sectional view taken substantially along line 11—11 of FIG. 1, showing the interlock means between adjacent units.

FIG. 10 shows the male/female members of two adjacent units just prior to interlock. FIGS. 1, 3 and 11 best show the members fully interlocked by sliding fit to connect the units side to side.

The male and female upstanding members are preferably broad, flat members extending vertically from the base sides and preferably have length dimensions at least about one-half that of the base sides from which they extend.

Component unit 20 differs from unit 30 only in the size of the base. As shown in FIGS. 1 and 3, the base 38' of unit 30 is substantially square and somewhat larger than base 38 of unit 20. The upstanding members 52, 54 of unit 30 are identical to the corresponding members of unit 20.

Figure 4:
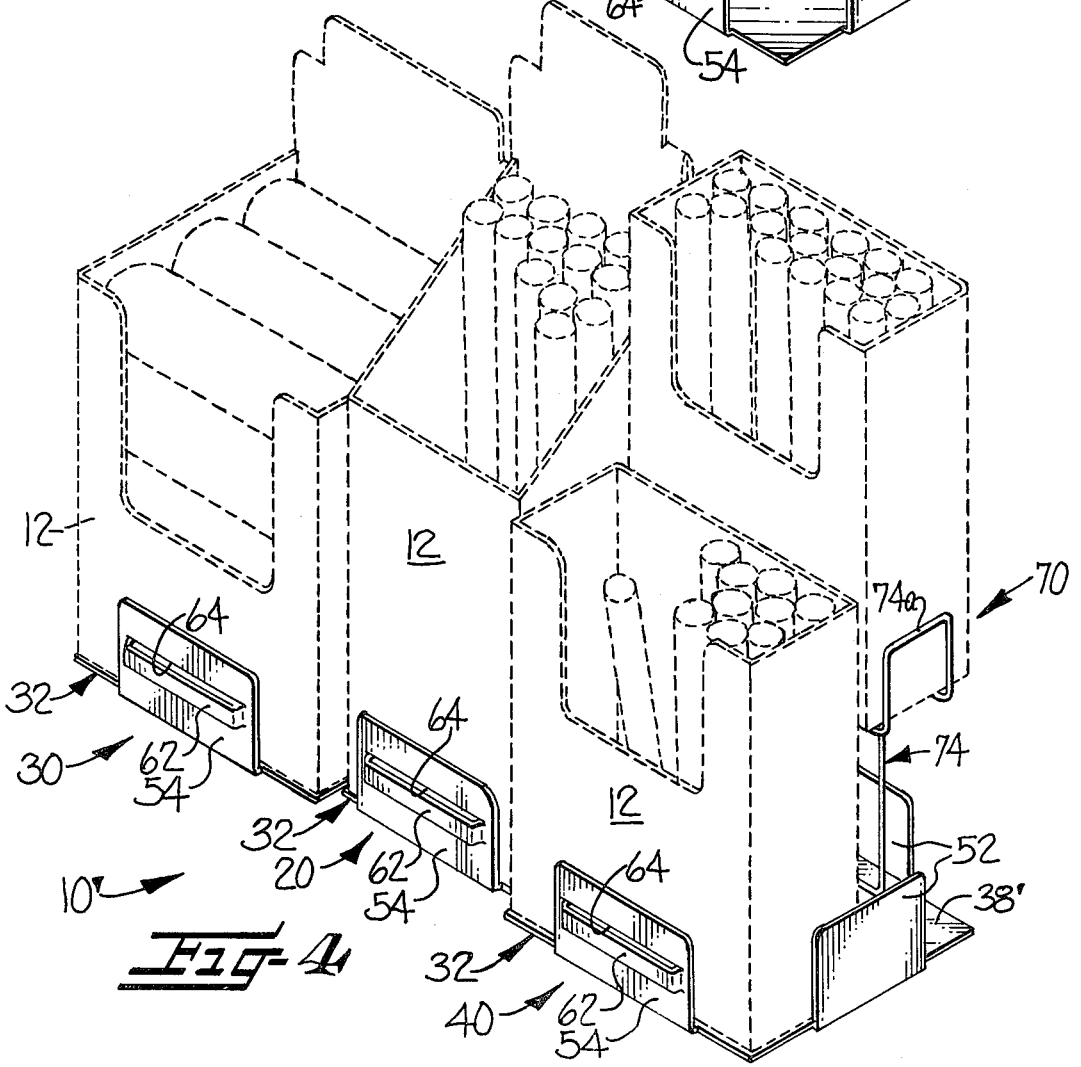
FIG. 4 is a perspective view of the system of FIG. 3 showing in dashed lines a plurality of caddies oriented for point-of-sale display.

FIGS. 3 and 4 illustrate a second arrangement of component units forming a modular display rack system 10' with a straight-line geometry. System 10' is formed from three component units—one each of the previously described units 20 and 30, and one tower unit 40.

Figure 9:
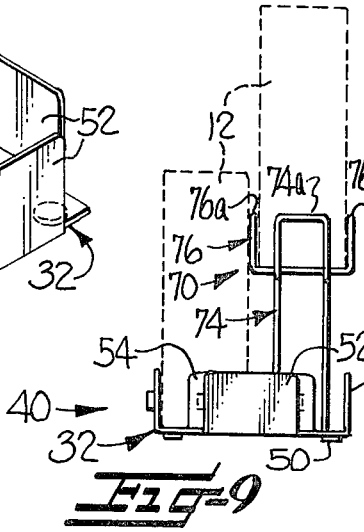
FIG. 9 is a side elevation of the tower unit with the caddies of comestible articles shown in dashed lines.

Tower unit 40 is formed with the same base and upstanding members as unit 30, but also includes a tower 70. As shown in FIGS. 4 and 9, unit 40 is used to support at different levels two caddies, each having a cross sectional area approximately ½ that of the caddy supported by unit 30.

Tower unit 40 provides additional versatility for the system of the invention. The two caddies supported by unit 40 may contain closely related articles, such as regular and spicy versions of a sausage product, thereby enabling the consumer to make an easy choice between two similar products.

Tower 70 may be formed from bent wire material secured to the upper support surface of unit 40 by welding, as at 72, or other suitable means. In the illustrated embodiment, tower 70 comprises a first portion 74 that is welded to the base and forms a pair of lateral caddy supports 74*a*, and an upper portion 76 that forms a pair of caddy supports 76*a*. As shown in FIGS. 4 and 9, caddy supports 74*a* and 76*a* engage the lower outer portion of a caddy to hold it in place at a level above that of a similar caddy that is supported on the support surface of the base of unit 40.

As best shown in FIGS. 2 and 4, the system of the invention facilitates ready access to the articles contained within the caddies and further permits the arrangement of the caddies in any desired array as may be most suitable for the particular sales location. For example, the caddies may be arranged in an L-shaped array as shown in FIGS. 1 and 2 for placement at the corner of a sales counter or for placement to extend adjacent to the sides of a cash register. As shown in FIGS. 3 and 4, component units may also be arranged in a straight-line configuration to accomodate other sales counters and sales objectives. A limitless number of configurations may be achieved.

The caddies may be provided with promotional information for catching the eye of the consumer and informing the consumer of the contents of each caddy. To this end, identifying indicia are preferably placed on the outer surfaces of the caddies above the level of upstanding members 52, 54. Further, the system of the invention provides surfaces, in the form of the exterior surfaces of the upstanding members 52, 54, for the placement of further promotional information. For example, the male members 52 provide uninterrupted vertical surfaces for the placement of promotional information in the form of printing, decals or any other desired form. It will also be appreciated that the upper support surfaces of the bases of the component units may be provided with information for informing the retail establishment of the various types of caddies that will fit into the particular component unit. This information may be used to assist the retail establishment in its inventory management.

While the present invention has been described in connection with several illustrated embodiments, modifications may be made without departing from the true spirit and scope of the invention.

What is claimed is:

1. A modular display rack system formed from a plurality of interlocked component units, said system being useful for the point-of-sale display of several different types of related consumer articles that are packaged in caddies according to article type and are sold individually at sales counters or like sales locations, the individual component units of said system comprising:

a base defining perimetric sides, said base having an upper support surface and an underside suitable for resting on a sales counter, or like surface;

a plurality of upstanding members extending upwardly from the perimetric sides of said base;

interior surfaces of said upstanding members being so configured as to define support and containment means for engaging the exterior of an upstanding consumer article caddy positioned on the base support surface and for holding the caddy such that the bottom of the caddy may be supported by the base support surface and such that the caddy may be held against lateral shifting by at least some upstanding members; and the upstanding members of adjacent units defining cooperative, mating interlock means joining the units side to side by a sliding fit;

wherein said mating interlock means joining the component units together comprises each component unit having interlock means defined by said upstanding members on the unit and comprising at least one male member at one of said base sides of the component unit and at least one female member at another one of said base sides, said male member being defined by one of said upstanding members comprising an upright tongue-like blade, and said female member comprising an upstanding member having an outwardly offset portion thereon defining a vertically oriented opening therein perpendicularly arranged with respect to the base, and being of a size so as to slideably receive therein the tongue-like blade male member of an adjacent component units to join the component units with each other in a horizontal side-by-side coplanar arrangement, whereby a caddy containing a selected multiple number of consumer articles of a particular type may be held by each of the component units of said system to provide an orderly display of several types of related consumer articles in a desired array.

2. A modular display rack system as claimed in claim 1 wherein the component unit bases are rectangular and an upstanding member extends from each of the four perimetric sides thereof.

3. A modular display rack system as claimed in claim 2 wherein said base and upstanding members are integrally formed from a single sheet of metal with the upstanding members joined to the base at 90 degree bend lines.

4. A modular display rack system as claimed in claim 3 wherein said male and female members have length dimensions at least about one-half that of the base sides from which they extend.

5. A modular display rack system as claimed in claim 1 wherein at least one component unit includes a tower served to and extending upwardly from its respective base, said tower defining supports adapted for holding a first caddy at an elevation above said base while allowing said base support surface to support a second caddy.

6. A component unit for a modular display rack system that is formed from a plurality of cooperative component units, said component unit being useful in the display of consumer articles of a type sold in individual units and packaged in substantial numbers, said component unit comprising:

a base defining perimetric sides, said base having an upper support surface and an underside suitable for resting on a sales counter, or like surface;

a plurality of upstanding members extending upwardly from the perimetric sides of said base;

interior surfaces of said upstanding members being so configured as to define support and containment means for engaging the exterior of an upstanding consumer article caddy positioned on the base support surface and for holding the caddy such that the bottom of the caddy may be supported by the base support surface and such that the caddy may be held against lateral shifting by at least some upstanding members; and said upstanding members further defining interlock means for cooperating with similar means on a similar adjacent unit to interlock multiple component units side by side into a modular rack system for displaying various consumer articles contained in multiple caddies, wherein said interlock means defined by said upstanding members comprises at least one male member at one of said base sides and at least one female member at another one of said base sides, said male member being defined by one of said upstanding members comprising an upright tongue-like blade, and said female member comprising an upstanding member having an outwardly offset portion thereon defining a vertically oriented opening therein perpendicularly arranged with respect to the base, and being of a size adapted to slideably receive therein the tongue-like blade male member of an adjacent component unit to interlock the component units with each other in a horizontal side-by-side coplanar arrangement.

7. A component unit as claimed in claim 6 wherein said upstanding members are integrally formed with said base.

8. A component unit as claimed in claim 6 including a tower secured to and extending upwardly from said base, said tower defining supports adapted for holding a first caddy at an elevation above said base while allowing said base support surface to support a second caddy.

9. A component unit for a modular rack system that is formed from a plurality of cooperative component units, said component unit being useful for displaying consumer articles of a type sold in individual units and packaged in substantial numbers in an upstanding box-like caddy having a rectangular cross section, said component unit comprising:

a substantially rectangular base defining four perimetric sides and having a size and shape approximating the cross-sectional size and shape of an upstanding consumer article caddy to be held thereby, said base having an upper support surface and having an underside suitable for resting on a sales counter, or like surface;

an upstanding member extending from each of the four perimetric sides of said rectangular base; interior surfaces of the upstanding members defining support and containment means for engaging the exterior of an upstanding consumer article caddy and for holding the caddy such that the bottom of the caddy is supported by the base support surface and such that the caddy is held against lateral shifting by said upstanding members; and said upstanding members further defining interlock means for cooperating with similar means on a similar adjacent unit to interlock multiple component units side to side into a modular rack system for displaying various consumer articles in multiple caddies, wherein said interlock means defined by said upstanding members comprises at least one male member at one of said base sides and at least one female member at another one of said base sides, said male member being defined by one of said upstanding members comprising an upright tongue-like blade, and said female member comprising an upstanding member having an outwardly offset portion thereon defining a vertically oriented opening therein perpendicularly arranged with respect to the base, and being of a size adapted to slideably receive therein the tongue-like blade male member of an adjacent component unit to interlock the component units with each other in a horizontal side-by-side coplanar arrangement.

10. A component unit as claimed in claim 9 wherein said base and upstanding members are integrally formed.

11. A component unit as claimed in claim 9 wherein said base and upstanding members are integrally formed from a single sheet of metal with the upstanding members joined to the base at 90 degree bend lines.

12. A component unit as claimed in claim 11 wherein said offset portion is punched out from the sheet metal forming the female member.

13. A component unit as claimed in claim 12 wherein said male and female members have length dimensions at least about one-half that of the base sides from which they extend.

14. A component unit as claimed in claim 9 including a tower secured to and extending upwardly from said base, said tower defining supports adapted for holding a first caddy at an elevation above said base while allowing said base support surface to support a second caddy.

15. A modular display rack system as claimed in claim 1 or 6 wherein said male member and said female member are in opposing relation to one another.

16. A modular display rack system as claimed in claim 15 wherein, said base is rectangular and includes an additional pair of opposing male and female members positioned on the two other sides of said rectangular base.

* * * * *